US009445972B2

(12) United States Patent
Arad et al.

(10) Patent No.: US 9,445,972 B2
(45) Date of Patent: Sep. 20, 2016

(54) MONITOR FOR MONITORING A COMSUMPTION OF PILLS FROM A CONTAINER

(71) Applicants: Eli Arad, Tzofit (IL); Nissim Zur, Givataim (IL)

(72) Inventors: Eli Arad, Tzofit (IL); Nissim Zur, Givataim (IL)

(73) Assignees: Eli Arad, Tzofit (IL); Nissim Zur, Givataim (IL)

( * ) Notice: Subject to any disclaimer, the term of this patent is extended or adjusted under 35 U.S.C. 154(b) by 0 days.

(21) Appl. No.: 14/658,282

(22) Filed: Mar. 16, 2015

(65) Prior Publication Data

US 2015/0257981 A1 Sep. 17, 2015

Related U.S. Application Data

(60) Provisional application No. 61/953,965, filed on Mar. 17, 2014.

(51) Int. Cl.

| | |
|---|---|
| ***A61J 7/02*** | (2006.01) |
| ***A61J 7/04*** | (2006.01) |
| *A61J 1/03* | (2006.01) |
| *A61J 1/14* | (2006.01) |

(52) U.S. Cl.

CPC ..... *A61J 7/0481* (2013.01); *A61J 7/0436* (2015.05); *A61J 1/03* (2013.01); *A61J 1/1412* (2013.01); *A61J 2200/30* (2013.01); *A61J 2200/70* (2013.01)

(58) Field of Classification Search

CPC ..... A61J 1/03; A61J 1/1412; A61J 7/02; A61J 7/04

USPC ..... 206/528

See application file for complete search history.

(56) References Cited

U.S. PATENT DOCUMENTS

| | | | | |
|---|---|---|---|---|
| 4,505,399 | A * | 3/1985 | Weiner | B65D 55/026 215/203 |
| 2003/0086338 | A1* | 5/2003 | Sastry | G06F 19/3462 368/10 |
| 2006/0071011 | A1* | 4/2006 | Varvarelis | A61J 7/0481 221/9 |
| 2008/0114490 | A1* | 5/2008 | Jean-Pierre | G06F 19/3462 700/241 |
| 2009/0222130 | A1* | 9/2009 | Morse | A61J 7/0472 700/225 |
| 2009/0294521 | A1* | 12/2009 | de la Huerga | A61J 1/035 235/375 |
| 2013/0035785 | A1* | 2/2013 | MacVittie | B65D 83/0409 700/231 |
| 2013/0116818 | A1* | 5/2013 | Hamilton | A61J 7/04 700/236 |
| 2014/0055267 | A1* | 2/2014 | Rothschild | A61J 7/0084 340/573.1 |
| 2014/0251850 | A1* | 9/2014 | Huang | A61J 1/03 206/459.1 |

* cited by examiner

*Primary Examiner* — Kevin Kim
(74) *Attorney, Agent, or Firm* — Reches Patents

(57) ABSTRACT

A monitor for monitoring a consumption of pills from a container, the monitor comprises: an interface; a controller; multiple sensors of different types, an alert element; and a transceiver that is configured to exchange information with one or more devices that differ from the monitor; wherein the interface is configured to interface with the container; wherein when the monitor interfaces with the container the multiple sensors are configured to (i) detect an attempt to consume a pill of the pills from the container and (ii) evaluate an amount of pills within the container; wherein the controller is configured to trigger an erroneous consumption alert when the attempt to consume the pill does not correspond to a desired pill consumption schedule.

17 Claims, 12 Drawing Sheets

10
20
30
40
50
60
70
1
51
80
4
3
2
7
6
9
9A
5
8

MONITOR FOR MONITORING A COMSUMPTION OF PILLS FROM A CONTAINER

RELATED APPLICATION

This application claims priority from U.S. provisional patent Ser. No. 61/953,965 filing date Mar. 17, 2014 which is incorporated herein by reference.

FIELD OF THE INVENTION

The present invention is related to new retrofitted electronic device to convert the conventional pills consummation monitoring of bottles into Artificial intelligence pills consumption monitoring bottles that help the users to take the right pills on the right time with the right pills dosage, and alert him on selecting the wrong pills' bottle precisely.

BACKGROUND OF THE INVENTION

Medications come in simple, screw-top bottles anyone can open. In a single USA city more than a thousand children per year were being poisoned after the unsupervised ingestion of these easily accessible medications.

The conventional bottles are made of plastic, paper, glass or metal consist of bottle caps and bottle containers. Bottle containers may vary a lot but bottle caps are very much standard which have only a few popular sizes. Millions of conventional bottles contain non-food, food, food supplements or medications been sold to consumers every day. For most medical or health related applications, the contents (pills inside these bottles) have to be taken regularly. Keeping track of regularly doses of medications can be difficult. Skipping or over dosages of certain medications can be harmful or deadly. Selection of the wrong pills' bottle extensively can be also harmful.

SUMMARY

There may be provided a monitor for monitoring a consumption of pills from a container, the monitor may include: an interface; a controller; multiple sensors of different types, an alert element; and a transceiver that may be configured to exchange information with one or more devices that differ from the monitor; wherein the interface may be configured to interface with the container; wherein when the monitor interfaces with the container the multiple sensors may be configured to (i) detect an attempt to consume a pill of the pills from the container and (ii) evaluate an amount of pills within the container; wherein the controller may be configured to trigger an erroneous consumption alert when the attempt to consume the pill does not correspond to a desired pill consumption schedule.

The container may include a body and a cover; wherein body has a body interface for connecting the body to the cover; wherein the interface matches the body interface.

The controller may be configured to trigger an missed consumption alert when the monitor did not detect an attempt to consume a pill that was due according to the desired pill consumption schedule.

The multiple sensors may be configured to sense at least one of the followings: (a) a movements of the container, (b) an opening of the container, (c) an amount of pills within the container, (d) a proximity of a human organ to the container.

The multiple sensors may be configured to sense all of the following: (a) movements of the container, (b) an opening of the container, (c) an amount of pills within the container, (d) a proximity of a human organ to the container.

The multiple sensors comprise: an infrared sensor for sensing a proximity of a human organ to the container, a gyroscope for sensing a rotation of the monitor; a proximity sensor for evaluating an amount of pills within the container; and an accelerator for sensing a displacement of the container and the cap.

The alert element may include a semi-transparent structure and a light emitting element for illuminating the semi-transparent structure.

The semi-transparent structure may include a radio frequency antenna.

The transceiver may be configured to retrieve desired pill consumption schedule.

The transceiver may be configured to retrieve, from another device, information about a physical condition of a person; wherein the controller may be configured to determine whether the person should consume a pill from the container based upon the information about a physical condition of a person.

The controller may be configured to trigger a recommended pill consumption alert if it may be determined that the person should consume the pill.

The monitor may be positioned within the container when the monitor interfaces with the container.

The monitor may be positioned outside the container when the monitor interfaces with the container.

The interface may include an adhesive sheet.

The multiple sensors comprise an ambient temperature sensor for sensing a storage temperature.

The monitor further may include at least one button for providing commands to the monitor.

The monitor further may include at least one button for providing commands to the monitor.

The controller may be configured to detect the attempt to consume the pill by comparing current readings from the multiple sensors to previous readings of the multiple sensors that may be associated with one or more previous attempts to consume pills.

In the following text there is a reference to artificial intelligence device. It is noted that artificial intelligence is a non-limiting example of a type of algorithms that can be executed by the device according to various embodiments of the invention.

There is provided a new user-friendly electronic Artificial Intelligence pills consumption monitoring Devices ("AID"). The AID device converts regular conventional pills' bottles to automatic ones. The AID device monitors the consumption of the pills in the bottles. The AID device is compatible and can be retrofitted on top a regular conventional pills' bottle cap. Or it replaces the bottle's cap totally. This AID device has a unique combination of sensors and Artificial Intelligence software algorithms to monitor consumption of pills and reminds the user to consume the right number of pills. When the user opens pills bottle cap on the bottle container with its AID device attached to, the inner processor detects, if the cap was opened, by IR proximity to the human hand and by unique monitoring the cap pills consumption by accelerometer and Gyro sensors. Moreover, the AID device can detect if the user really takes the pills or just 'open' and 'close' the pills' cap. The AID device can detect also how many pills remain in the bottle and reports to its linked smart phone request for new pills' bottle. This information is processed wirelessly and been sent to a smart phone using Bluetooth Smart radio transmission. Then it forwards to Internet data base server and to the care taker of the patient. The wireless link of the AID device to smart phone, or in a similar way, allows the AID device to remind the user which bottle was not opened, using human voice. If the user picked or opened the wrong bottle, an alarm will be sound on the AID device and on the smart phone. The AID device has a wireless link to all surrounding Bluetooth Smart devices and can offer to consume pills' dosage based on the wireless reported from that device, as been reported from Bluetooth Smart Glucometer, Bluetooth Smart heart rate, Bluetooth Smart blood pressure etc. The AID device can detect consummation of pills too often and report alert and send it to his care taker via the internet.

DETAILED DESCRIPTION OF THE DRAWINGS

Figure 1:
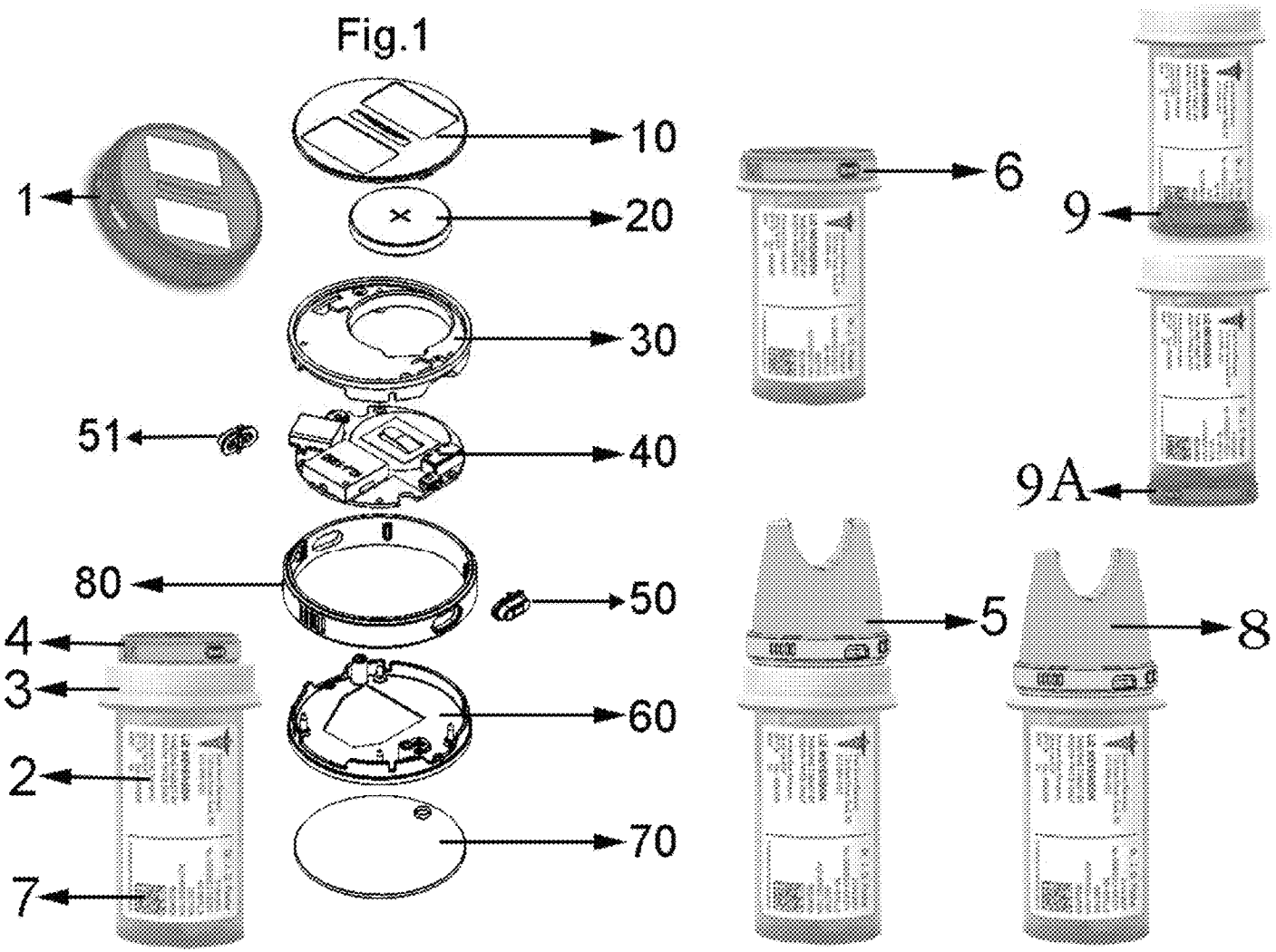
FIG. 1. Shows the AID device inner building block of six possible forms according to various embodiments of the invention.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

Because the illustrated embodiments of the present invention may for the most part, be implemented using electronic components and circuits known to those skilled in the art, details will not be explained in any greater extent than that considered necessary as illustrated above, for the understanding and appreciation of the underlying concepts of the present invention and in order not to obfuscate or distract from the teachings of the present invention.

Any reference in the specification to a method should be applied mutatis mutandis to a system capable of executing the method.

Any reference in the specification to a system should be applied mutatis mutandis to a method that may be executed by the system.

The present invention is directed to provide such a solution with an electronic artificial intelligence device with computerize controller that senses the world through a unique combination of sensors linked to artificial intelligence algorithm with a wireless link to smart phone. The AID device circuits generate audible, visual and wireless link. With ability to activate human voice guide from smart phone or Wi-Fi Bluetooth multimedia bridge devices.

The present AID device may be retrofitted on top or replaces the regular conventional bottle caps for monitoring pill consummation and remind the users to take their pills in a timely and according to the dosage needed. The AID device has a wireless link to all surrounding Bluetooth Smart devices and can offer to consume pills' dosage based on the wireless been reported from those Bluetooth Smart devices, or as reported from Bluetooth Smart Glucometer, Bluetooth Smart heart rate, Bluetooth Smart blood pressure etc. The AID device can detects too often consummation of pills and report an alert and send to his care taker on the internet as may needed.

The AID device may include a CPU controller with a unique combination of sensors that feed the serial ports to the CPU Artificial Intelligence algorithms.

The AID device can sense a human hand touching the pills' cap by Infra-Red ("IR") sensor. This sensor window is pointing up.

Accelerometer sensor senses when pills' bottle been picked up and when the cap with the AID device been placed on the table. Also it can detects an opening of bottle popped cap without rotation.

Gyro reports the Artificial Intelligence a rotation of the pills cap. Counter clock wise to close the pills cap, or clock wise to open the pills bottle cap.

Proximity sensor facing into the bottle, reports the Artificial Intelligence the height of pills inside the bottle.

A temperature sensor detects the storage temperature of the pills' bottle

Proximity detection to a wireless device with "speaking" capabilities as Smart phone, Bluetooth Smart ready device with speaker, Wi-Fi Bluetooth multimedia devices.

Proximity detection to a wireless device with "Internet access" capabilities as Smart phone, Wi-Fi Bluetooth multimedia devices.

Identify if the bottle is empty of pills using it's proximity distance sensor.

When the user picks up a pills' bottle, the AID device senses the user intention to consume pills by:

a. Infra-Red ("IR") sensor detects proximity of the user palm on top of the pills bottle cap.
b. The Accelerometer reports the pills' bottle in a human hand, since it senses the natural human hand vibration.
c. The Gyro senses the rotation pills consumption of pills' bottle cap.

If this kind of pills consumption was not scheduled or has no "sense" to consumption of these pills according the AID device data base, an alert will be sound by the AID device.

The AID device Artificial Intelligence decision making process "senses" if this intention of consuming pills now is right or wrong. For example, if the Artificial Intelligence data base has a record to consume a pill 3 time a day, at 08:00, 12:00, and 18:00. So if the user intends to consume the pills 1 hour before—it may be "OK". If he did not consumes the pill of 12:00 and opens the cap at 14:00, is also "OK".

But if the user takes a pill at 12:00, and tries to take a again pills on at 12:30 that may indicted that the user forgot, and the AID device starts an alert.

Another example is about class of pills that needs to be consumed based on Wireless messages as Bluetooth Smart device sensors. For examples: pills for lowering heart rate. When the user checks his heart rate using wireless Bluetooth smart device, the AID device gets wireless report and can "expect" to use the pills for heart rate. It can also flash light on the right AID device heart rate pills' bottle cap.

Moreover, from the above example AID device will start flashing the relevant caps at 8:00, 12:00, and 18:00 to remind the user.

a. Forms of alerts by the device.
B. RED Lights on the AID devices.
C. Vibration on the AID devices.
D. Buzzing of alarm noise on the AID devices.
E. AID device transmits this alerts to events:
   1. to Smart phone or wireless Wi-Fi Bluetooth smart devices to play a human voice message and/or:
   2. Send SMS and other electronic message to the user caretaker.
   3. Send a phone call with interactive voice respond to caretaker The AID device Artificial Intelligence also takes proactive actions to notify the user to take the pills when skipping by:

A. Green/white Lights on the AID device.
B. Buzzing of nice beeps on the AID device.
C. AID device also transmits this event:
D. Activated the Smart phone or wireless Wi-Fi Bluetooth smart device to play a human voice message and/or:
   1. Sending SMS and other electronic message to caretaker.
   2. Send a phone call with interactive voice respond to the user and his caretaker The AID device monitors pills consumption reminder device requires no modification, nor new design of conventional pills' bottle containers. This will save a lot of time and money for engineering, tooling, molding and manufacturing costs of a new bottle container.

The AID device monitors pills' consumption device that does not requires a new replacement, modification, or new design of conventional bottle cap, unlike the others. The conventional bottle cap works with The AID device monitors pills' consumption device. Again, this would save a lot of time and money for engineering, tooling, molding and manufacturing costs of a new bottle cap.

The AID device monitors pills' consumption device is compatible to both childproof and non-childproof type of bottle caps.

The AID device monitors pills' consumption device attaches nothing outside of the conventional bottle container or bottle cap; no extra storage space is required to store The AID device monitors pills' consumption device and there is no visual impact to users. There is no appearance difference between conventional bottle and The AID device "converted" monitors pills' consumption bottle. This would help the conventional bottle users to get used to the new monitors pills' consumption bottle, very quickly.

The AID device monitors pills' consumption device is environmentally sealed and protected inside the conventional pills' bottle.

The AID device monitors pills' consumption device is a user-friendly device. Nothing for user to learn, no push-buttons to push, setup is not required and user does not have to realize The AID device monitors pills' consumption device is inside his/hers pills bottle. The AID device monitors pills' consumption device, will simply notify the users to take their pills or alert them by doing a mistake. Where the user is near or far from the AID device.

The AID device monitors pills' consumption device uses high precision, reliable auto learning Artificial Intelligence algorithms for monitor's pills consumption.

The AID device monitors pills' consumption device utilizes its wireless radio frequency (RF) channel to notify and alert the user by using a human voice. In some cases these wireless channels useful for caretaker monitoring the user's activity remotely.

The AID device has the ability to prevent from user to pick the wrong pills' bottle by mistake.

The AID device has the ability to detect the inner content of the pills' bottle, by proximity sensor which points into the bottle and the AID device Artificial Intelligent sends wireless event for refilling to the caretaker.

The AID device has the ability to detect the user hand opening the cap. Since the Human hand palm radiate IR rays that are detected by the AID device IR sensor.

The AID device has the ability to detect that the bottle has been picked up and not just carry in a bag, by Artificial Intelligence detects zero pills consumption and pills consumption up for short distance.

The AID device has the ability to detect opening the bottle cap by its Gyro and Accelerometer.

The AID device has the ability to detect the "real" pills consumption of pills, since it can detect several stages of pills consumption. This is the base for "Artificial Intelligence algorithms", all the movement and time of the below action is stored in table and new action is compere to old storage of the similar action. The readings of the multiple sensors that are associated with an attempt to consume a pill may be stored and used as a reference for detecting future attempts. The processor may be configured to build, from one or more attempts, a profile of a valid attempt and compare future readings to that profile. The profile may include parameters such as duration of different phases in the pill consumption and expected sensor readings for each phase.

Example of parameter storage (may be referred to as artificial intelligence parameters):

a. When the user normally use the AID device, on buzzing or +/− minutes before after.
b. Average Time to open the cap
c. Average time to place the cap on the table
d. Average time to pick the cap back
e. Average time to screw the cap back
f. Average time to place AID back on the table or bag Here is the Artificial Intelligence algorithms:
   a. Pick up the pills' bottle: Accelerometer reports acceleration upward.
   b. Open the pills' bottle cap with the AID device: by human IR and Gyro rotation and Accelerometer moment.

c. Place the pills' bottle cap with the AID device on the table, it senses: zero IR, Zero Gyro rotation and Zero Accelerometer acceleration
d. Time passed to take the pills out of the bottle.
e. Picked up the pills' bottle cap with the AID device: by Accelerometer moment.
f. Closing the bottle: by human palm IR, Gyro rotation and Accelerometer moment.
g. Place the pills' bottle back on the table. Accelerometer reports acceleration downward.
h. Pills back on table: Accelerometer report end of the pills consumption action.

The disclosed embodiments and advantages thereof are best understood by referring to FIGS. 1-11, like numerals being used for like and corresponding parts of the various drawings. Other features and advantages of the disclosed embodiments will be or will become apparent to one of ordinary skill in the art upon examination of the following figures and detailed description. It is intended that all such additional features and advantages be included within the scope of the disclosed embodiments, and protected by the accompanying drawings. Further, the illustrated figures are only exemplary and not intended to assert or imply any limitation with regard to the environment, architecture, or process in which different embodiments may be implemented.

The present invention contains an Artificial Intelligence pills consumption monitoring Device ("AID"). The AID device, is a retrofit kit, adds a button size electronic circuit board inside the regular conventional bottle cap. Or retrofit kit on top of the pills' bottle cap or inside the inner space of the cap. The AID device senses the user's hand touching the AID device at the opening or closing of a pills' bottle cap. The user or caretaker simply installs this AID device by, replacing the original bottle's cap or attaches it on top of the cap.

The AID device is CPU controller with a unique combination of sensors that feeds these reports to the CPU Artificial Intelligence algorithms.

FIG. 1. Shows the AID devices inner building block and possible 6 forms.

a. AID device placed on top of pills bottles cap 4.
b. AID device replaces pills cap 6.
c. AID device with high "hat" placed on top of pills bottles cap 5. The "hat" is semitransparent and glows from the inside. It designed for easier opening and moderated RF range. The antenna can be PCB antenna or chip antenna on PCB. The range in moderate. All the hat is use for light glowing. The two tops picks.
d. AID device with high "hat" replacing pills bottles cap 8. The "hat" is semitransparent and glows from the inside. It designed for easier opening and longer RF range since it uses a standing antenna inside the "hat". The antenna can be ¼ or ½ RF wave length standing antenna vertical, going up in one of the two hat tops. This vertical antenna extended the RF range to the maximum, but cost a bit more. All the hat cap will glow a bit less due to the presence of the long range antenna.
e. AID device placed inside the pills' bottles 9. This is useful when the pills' bottle cap top is not flat, or has some mechanical obstacles to be attached.
f. AID devices placed at the bottom of the pills bottles 9A. This is useful when the pills' bottles cap top is not flat, or has some mechanical obstacles to be attached.

Other versions exist, when the AID devices integrated in the pills' bottle itself. Inside the bottle plastic. As needed in disposable bottles or non-bottle shapes of pills container.

It also shows, in pictorial all AID device parts. The AID device itself1. And the internal major components of the AID device present invention. The AID device battery covers 10. The AID device battery 20. The AID device top plastic case 30. The AID device PCB 40. The AID device plastic ring 80. The AID device on/off button 50. The AID device function button 51. The AID device bottom plastic 60. The AID device adhesive sticker or finish plastic 70. The AID device adhesive sticker allows the AID device to easy attach to any pills bottle cap.

More than one AID device 1 may be utilized on same site. One AID device 1 may be placed on each pills' bottle cap whose pills consumption is desired to be detected. For example, in a site with four pills' bottle, 4AID devices detecting means 4AID devices may be utilized, one on each pill's bottle. However, minimum one smart phone or Wireless voice device is necessary, regardless the number of AID devices be in used, if a human voice guidance is desired.

There is no limit for the number of AID devices which may be used with one smart phone. There is no limit for the number of smart phone apps, within one smart phone that may be used to interact with all the AID devices. There is no limit for the number of smart phones that may be used to interact with AID devices. Meaning that at same location, may be many smart phones getting notifications from all AID devices simultaneously. Moreover, on every smart phone can be several apps that can use AID devices notification to do parallel tasks. The "Smart phone" represents any wireless device that can get interface to AID device wireless channel and bridge that to internet with local speaker capacities.

On each pills bottle cap 3 there is text label 2 with instructions, and QR label 7 to download the smart phone apps automatically with the read pre configure dosage and time.

Figure 2:
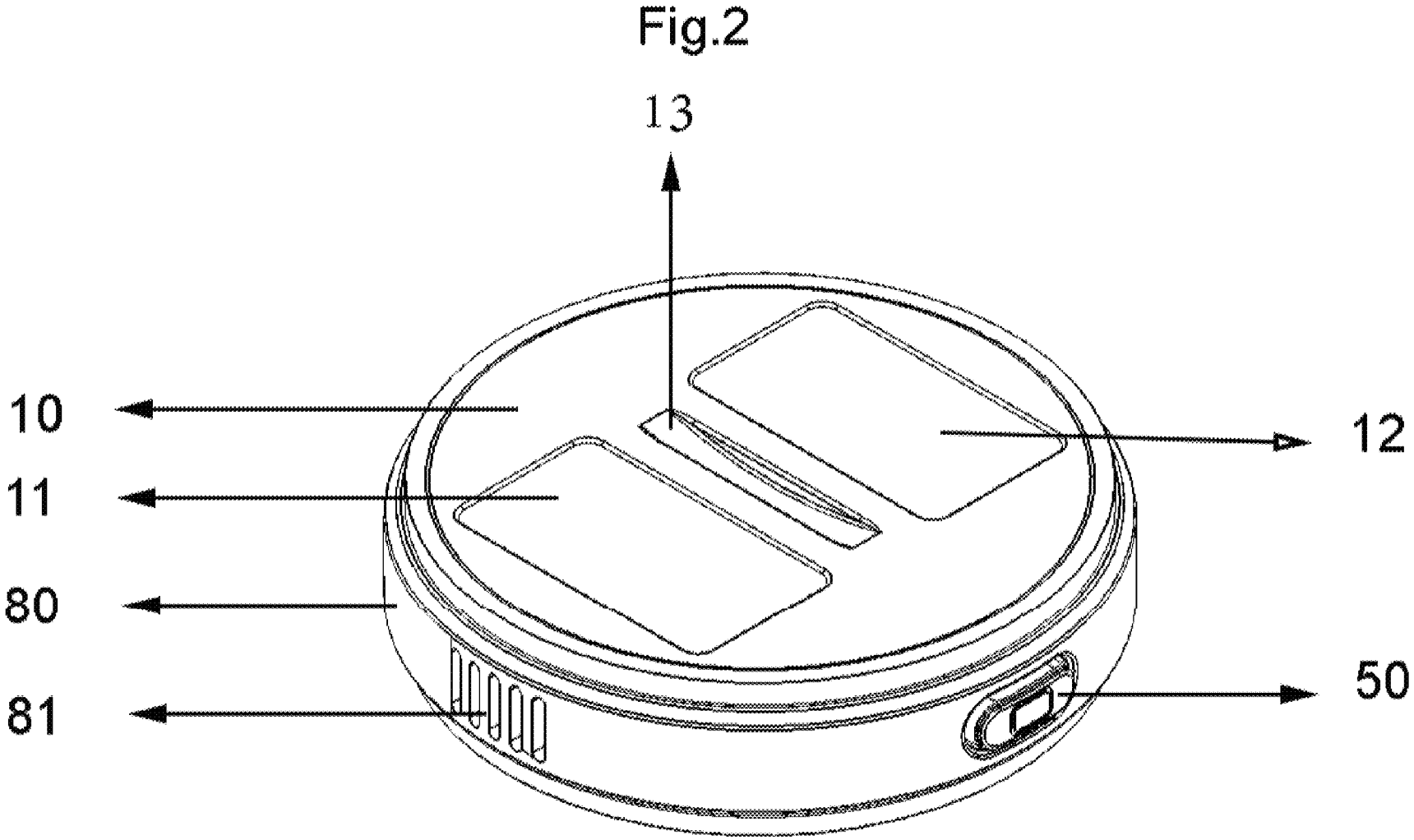
FIG. 2. Shows the AID device main outside parts on the up-according to an embodiment of the invention.

FIG. 2 Shows, in pictorial all AID device external parts. The AID device ring 80. The ring windows 81 to let the buzzer sound out. The AID device on/off button 50. The AID device label 11 QR code to automatic download the smart phone apps and configure the AID devices to the drug or/and to dosage and consumption guide. The AID device security number 12 to secure pair with the smart phone apps. The AID device QR code and the security code prevents from others smart phone apps to control the AID device. The AID device battery coin open cavity 13. AID device battery cover 10.

Figure 3:
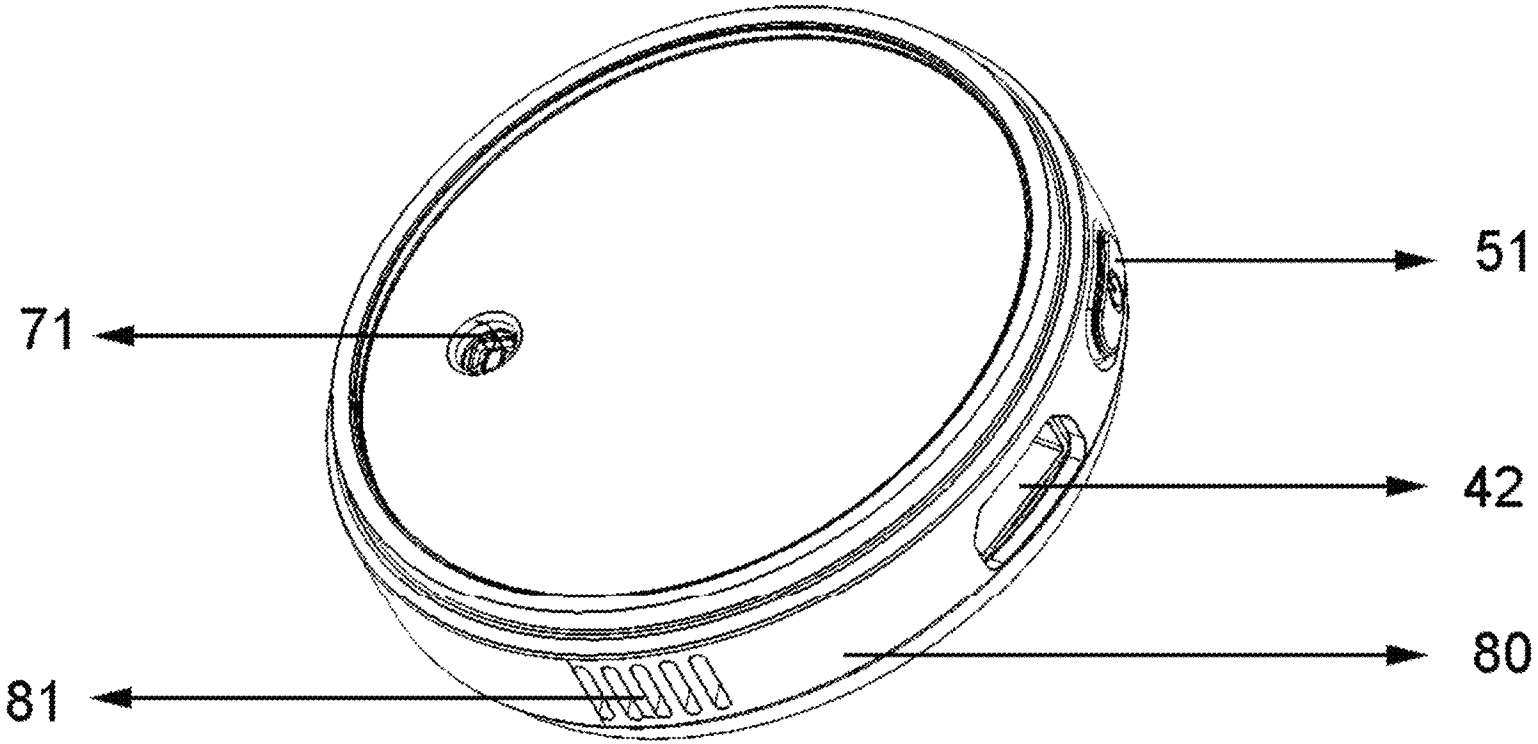
FIG. 3. Shows the AID device main outside parts on the downside right according to an embodiment of the invention.

FIG. 3 Shows, in pictorial all the AID device back side. This side sticks to pills bottle cap. The button functions selector 51. This button can select different mode of operation. For example: long pressure on button 51 moves the AID device to auto recognize state (or "pair") with the smart phone apps. And add the smart phone unique identify number to a white list inside the AID device. This white list allows only the registered smart phone apps to command the AID device and to get pills consumption data live or history stored data. Connector 42 is an extension port. It allows program the device with different firmware; add external devices over digital and analog wires. It allows power the AID device from external power source, or to feed power to external devices. The AID device connector 42 supports server mode of operations, digital output PIO as 3V and GND. Digital input as PIO as 3V and GND. Digital busses as I2C and UART, to connect to more button devices as AID devices that can stick on top of the AID devices. It can be used also to operate an external high light or horn for users with hearing problems. The proximity distance sensor 71 is used to detect the pills level in the bottle.

The Aid device buzzer windows 81 is used to alert the user by alarm sound. The Aid device ring 80 can be made by semitransparent plastic to glow when the inner LEDs notify the user to use these pills from this bottle at this time.

Figure 4:
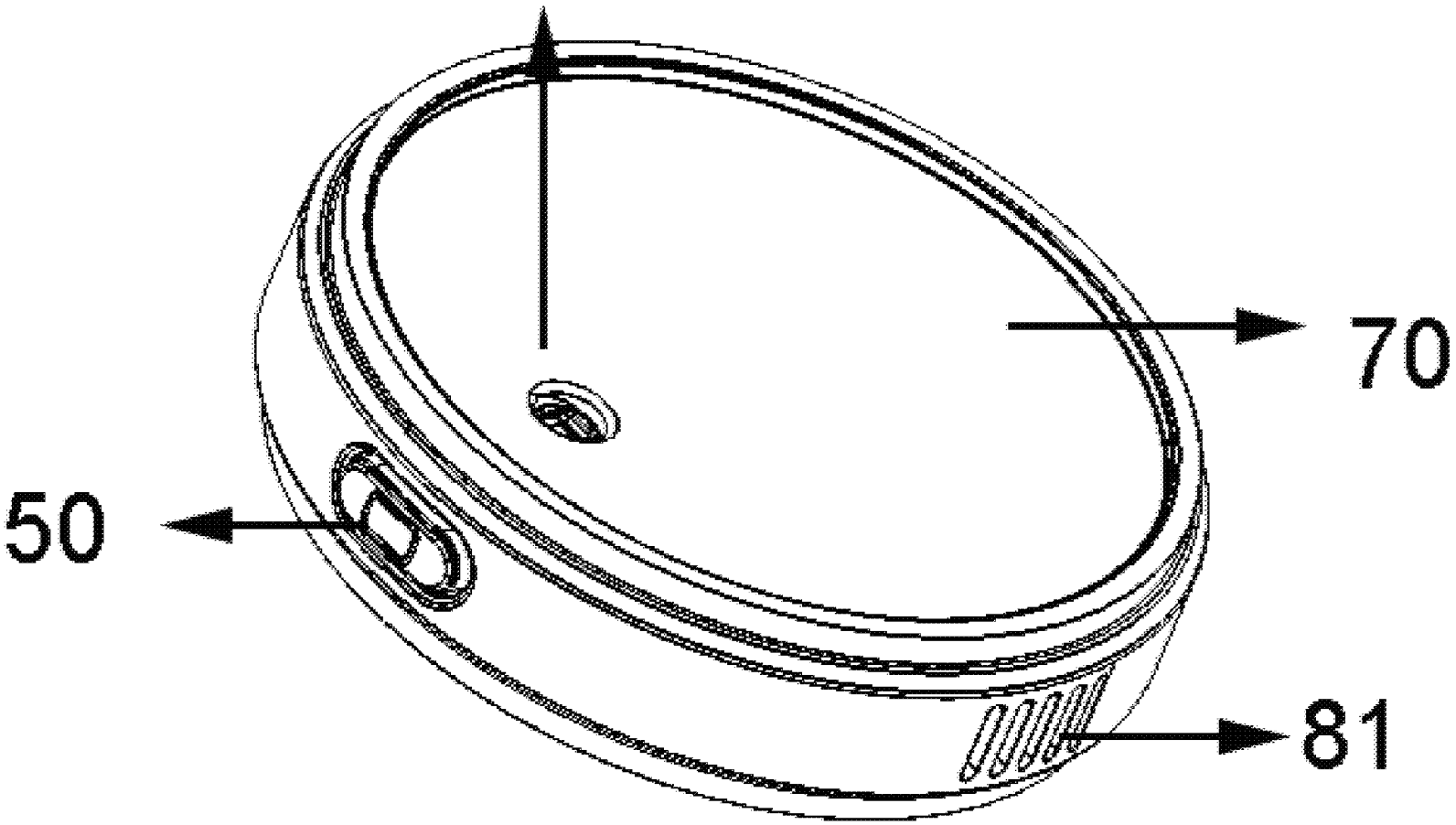
FIG. 4. Shows the AID device main outside parts on the downside left according to an embodiment of the invention.

FIG. 4 Shows, in pictorial all the AID device's back side as FIG. 3 with the sticker place 70. The AID device on/off switch 50. The proximity distance sensor 71 is used to detect the pills level in the bottle.

The Aid device buzzer window 81 is used to alert the user by alarm sound

Figure 5:
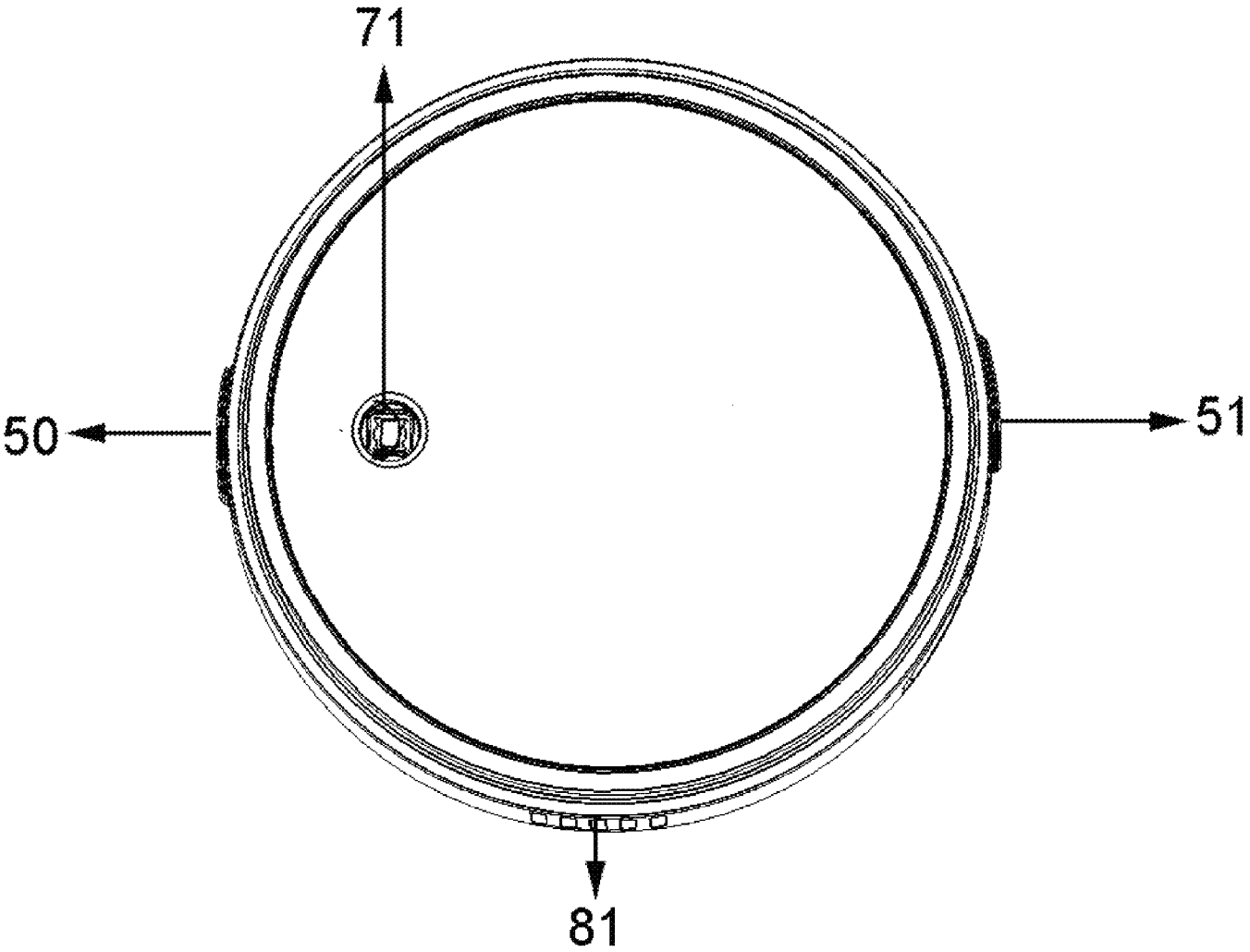
FIG. 5. Shows the AID device main outside parts on the downside front according to an embodiment of the invention.

FIG. 5 Shows, in pictorial the AID device from front. All parts are described already in FIG. 1, 2,3, 4.

The Windows 71 is a proximity distance detector, and it detects the level of pills inside bottle cap. That can be possible only when pills' bottle cap is transparent or the AID devices replaces the pills bottle cap. When the AID device inserted inside the pills' bottle cap bottom, this windows points up, and when covers by pills there is no event. But when there is few or no Pills this sensor 71 detects long distance to the pills' bottle cap from the inside, and sends event to smart phone to order new pills bottle.

Figure 6:
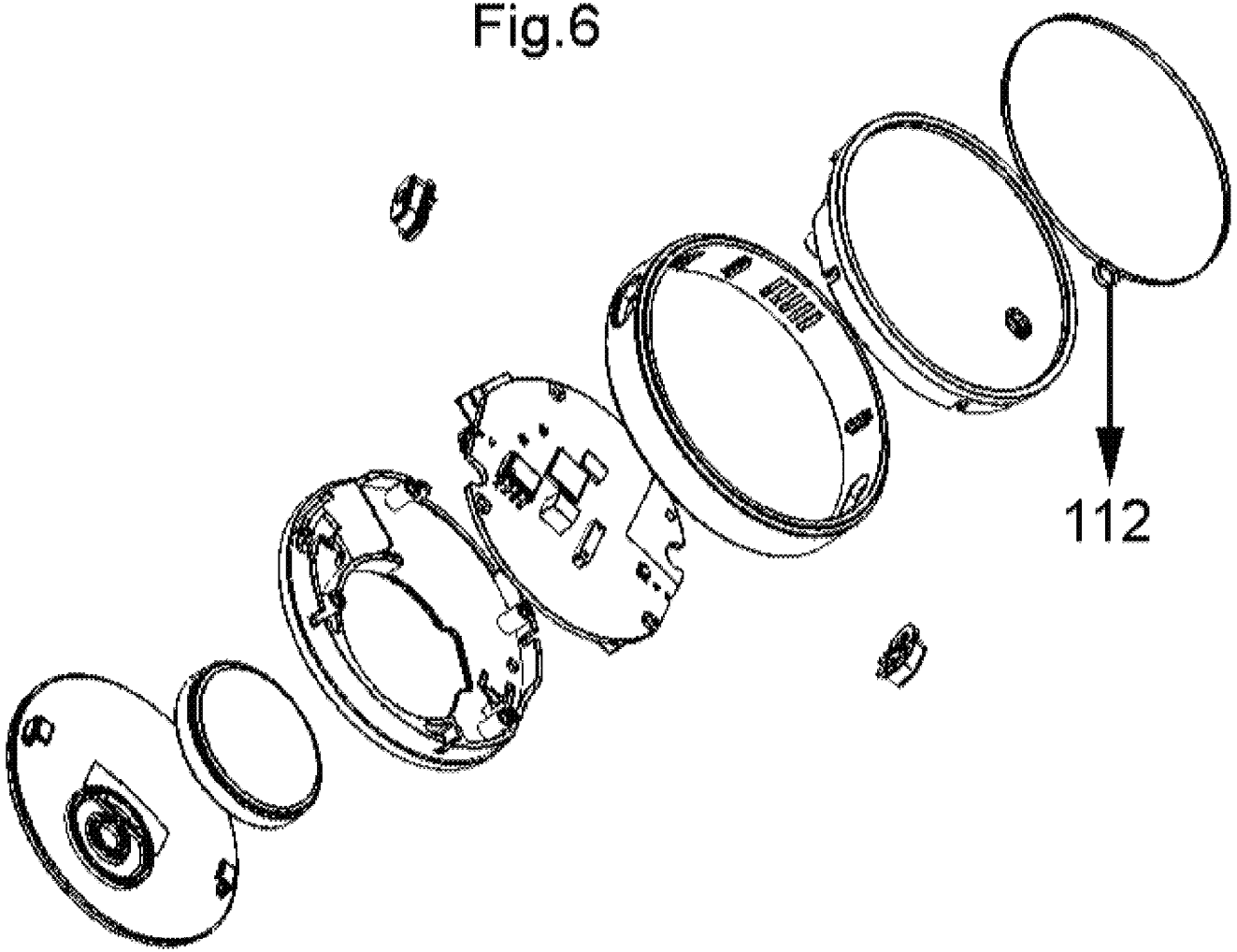
FIG. 6. Shows the AID device spread according to an embodiment of the invention.

FIG. 6 shows, in pictorial the AID device open with its PCB where the components side is shown. 112 is a proximity distance detector cover transparent window, and it detects the level of pills inside bottle cap.

Figure 7:
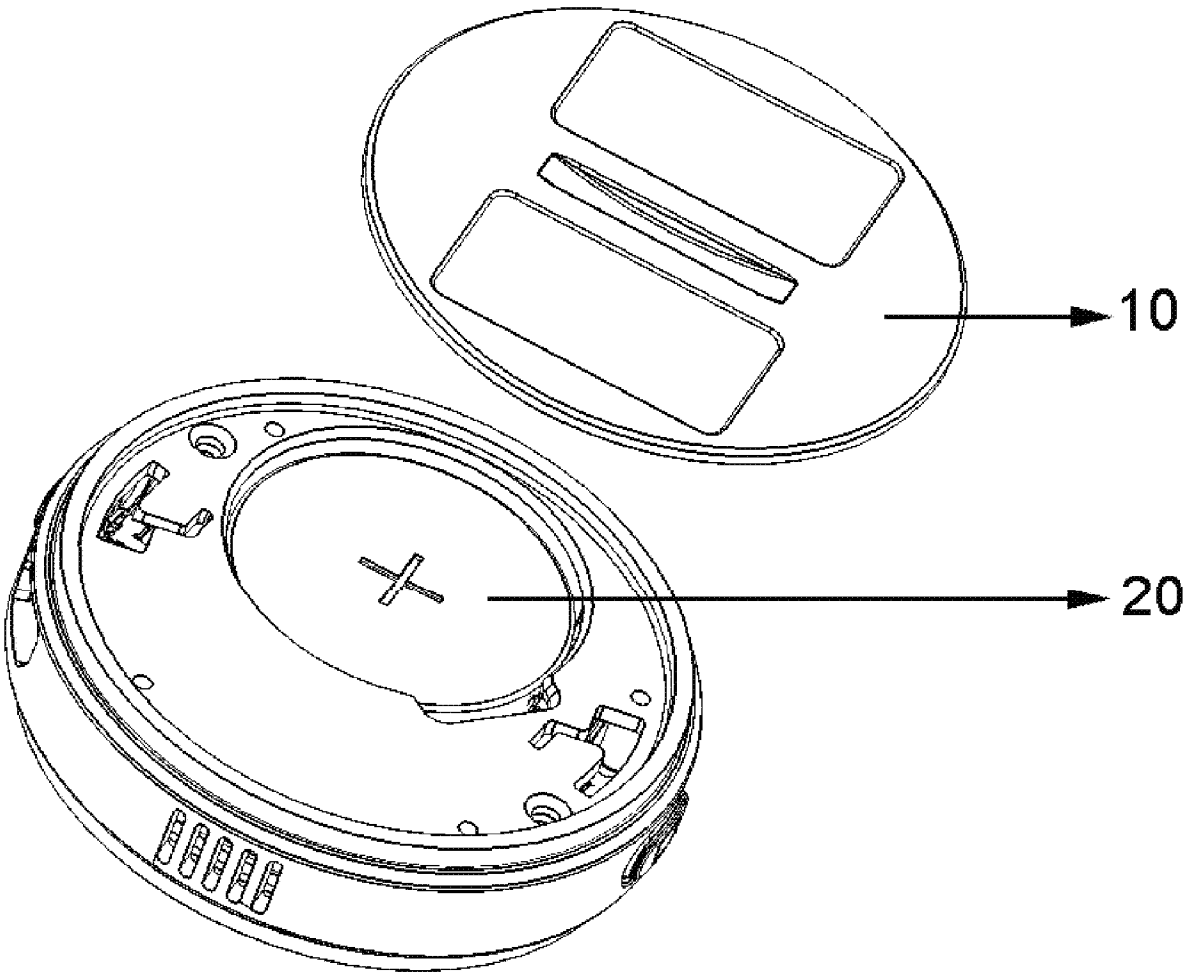
FIG. 7. Shows the AID device battery cavity and its according to an embodiment of the invention.

FIG. 7 Shows, in pictorial the AID device battery cover 10 and the place of the battery 20. The battery type is CR2032 but any other battery can be used to extend personal time.

Figure 8:
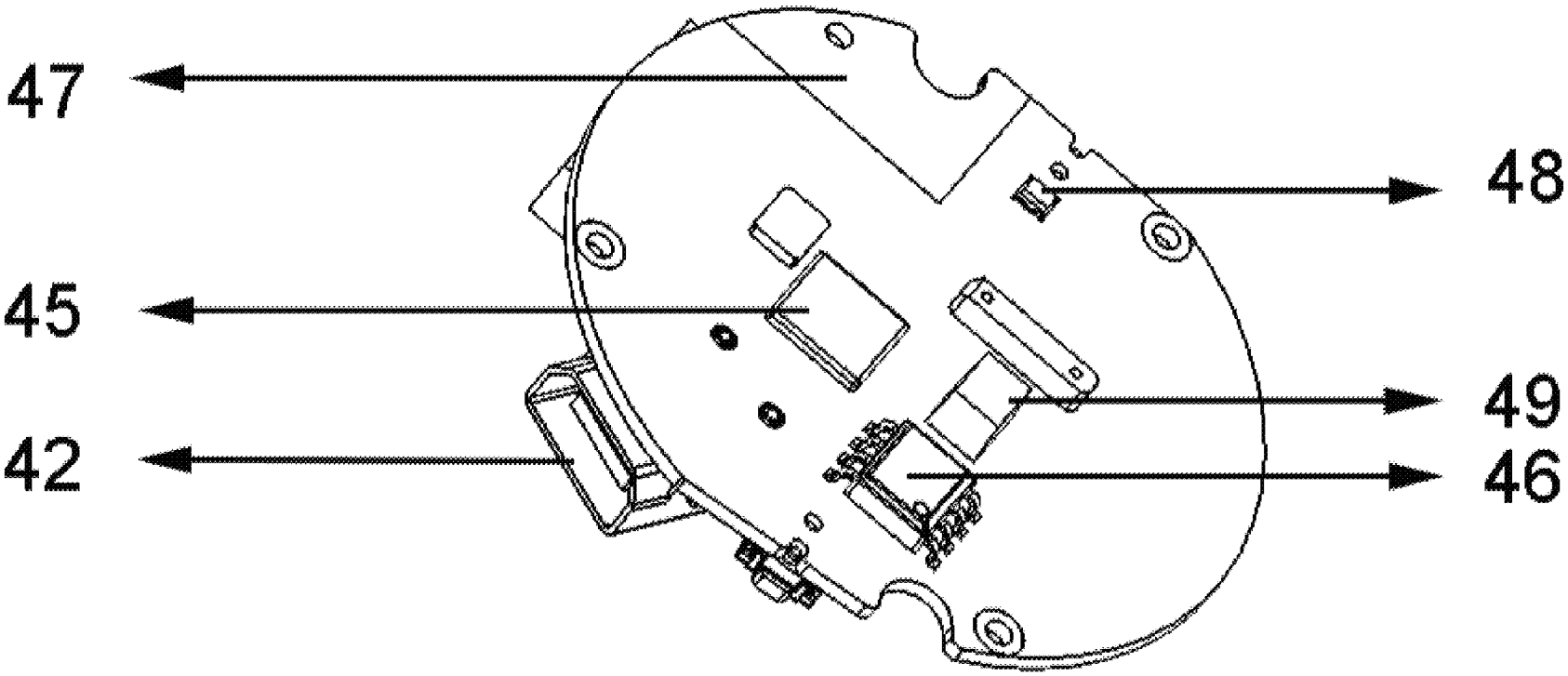
FIG. 8. Shows the AID device PCB part side, and its main according to an embodiment of the invention.

FIG. 8 shows, in pictorial the AID device PCB components side. The infrared temperature sensor 48, part number tmp006. The place of the printed antenna 47. CSR1010 AID device controller and RF transmitter 45. The connector 42. The AID device memory AT24C512C-XHM-T 8-lead TSSOP 46. The AID device pills' consumption accelerometer MMA7660FC 49. The present invention is not limited to this unique parts number, and any other chips with same functionality also may be used.

Figure 9:
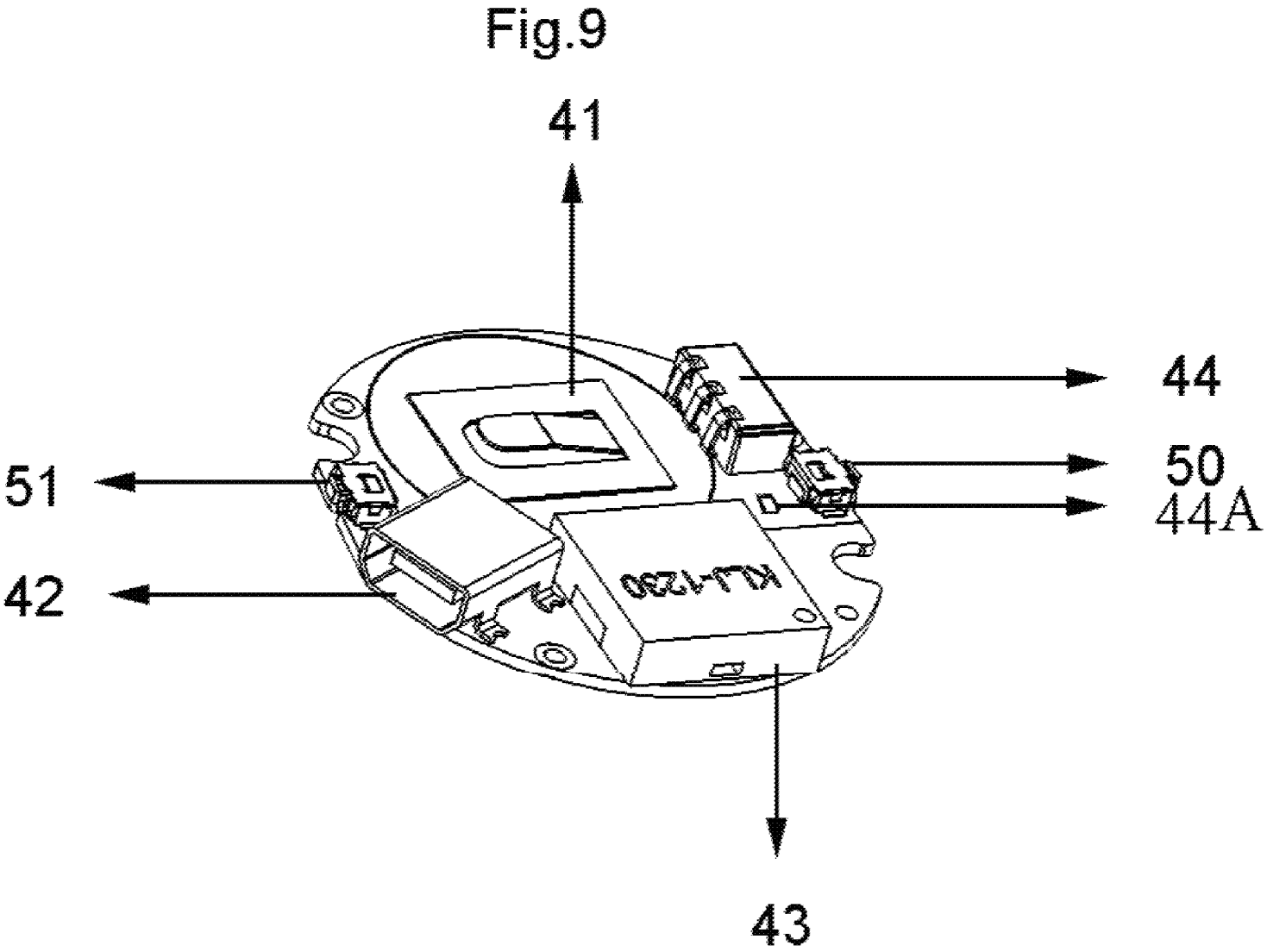
FIG. 9. Shows the AID device PCB battery side, and its main according to an embodiment of the invention.

FIG. 9 Shows, in pictorial the AID device PCB connector side. The battery side holder 44. The AID device on/off button 50. The AID device buzzer 43. The AID device connector 42. The AID device function button 51. The battery spring holder 41. The proximity distance detector 44A which detects the level of pills or liquid inside bottle cap.

Figure 10:
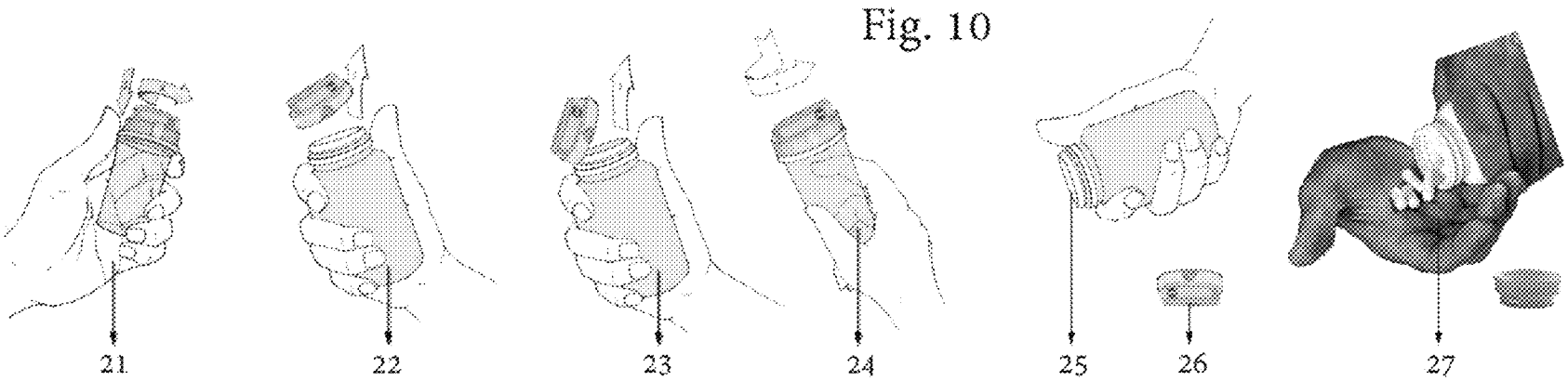
FIG. 10 Shows the variety of pills' bottle which AID device supports according to an embodiment of the invention.

FIG. 10 Shows, in pictorial several kind of pills' bottle cap "opening" that the AID device can detect their opening movement. Push in and rotate 21. Pop up pills bottle cap 22. Pop up attached pills bottle cap 23. Simple rotate pills bottle cap 24.

The present invention has the ability to detect the "real pills" consumption of pills, since it can detect several stages of human activities before the pills consumption.

a. Pick up the pills' bottle: 25 Accelerometer reports acceleration upward.
b. Open the pills' bottle cap with the AID device: by human IR and Gyro rotation and Accelerometer moment.
c. Place the pills' bottle cap with the AID device on the table 26, it senses: zero IR, Zero Gyro rotation and Zero Accelerometer acceleration or movement
d. Time passed to take the pills out of the bottle 27.
e. Picked up the pills' bottle cap with the AID device: by Accelerometer moment.
f. Closing the bottle: by human palm IR, Gyro rotation and Accelerometer moment.
g. Place the pills' bottle back on the table. Accelerometer reports acceleration downward.
h. Pills back on table: Accelerometer report zero movement.

Figure 11A:
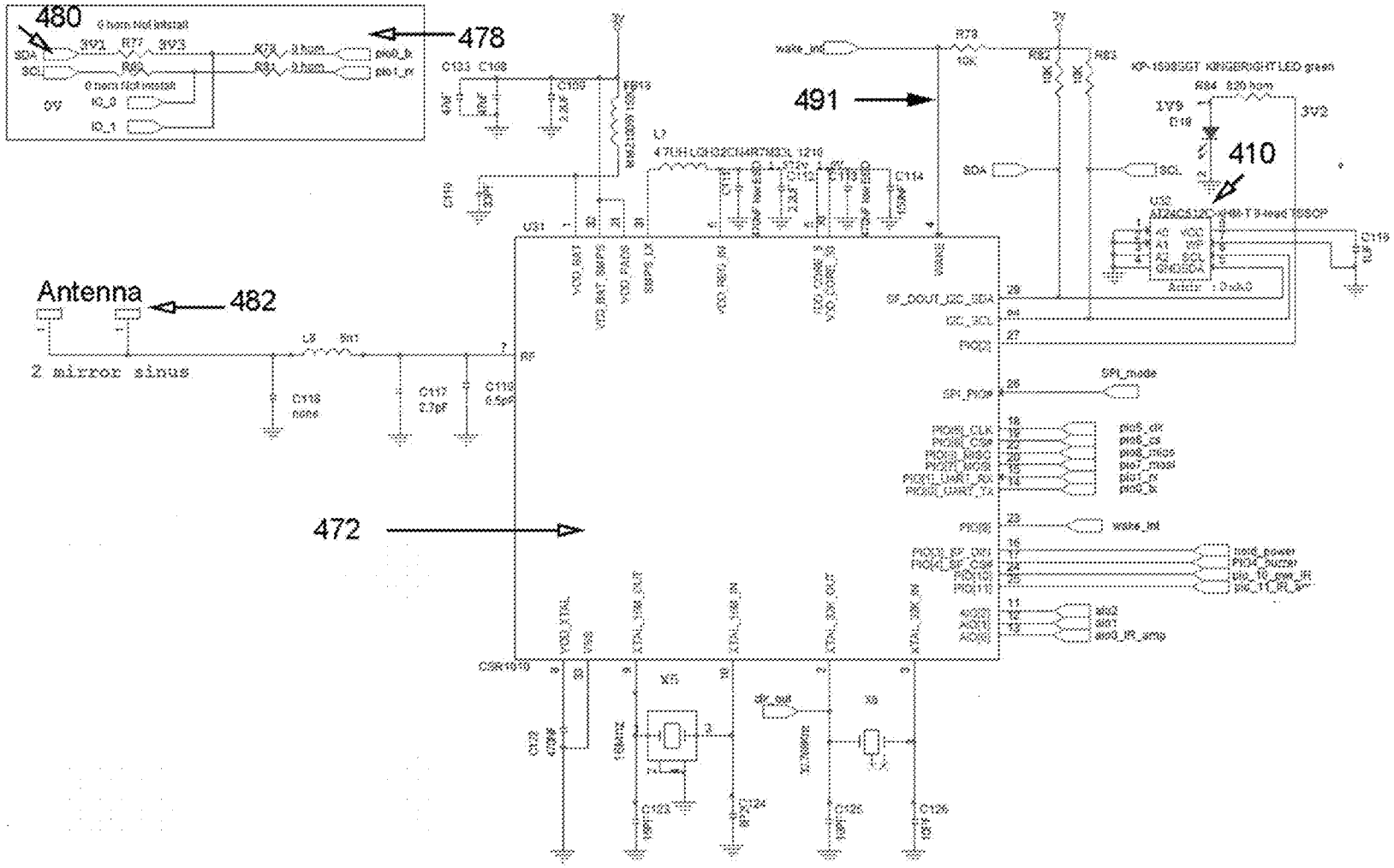
FIGS. 11A-11B Show the AID device detailed schematic diagram according to an embodiment of the invention
Figure 11B:
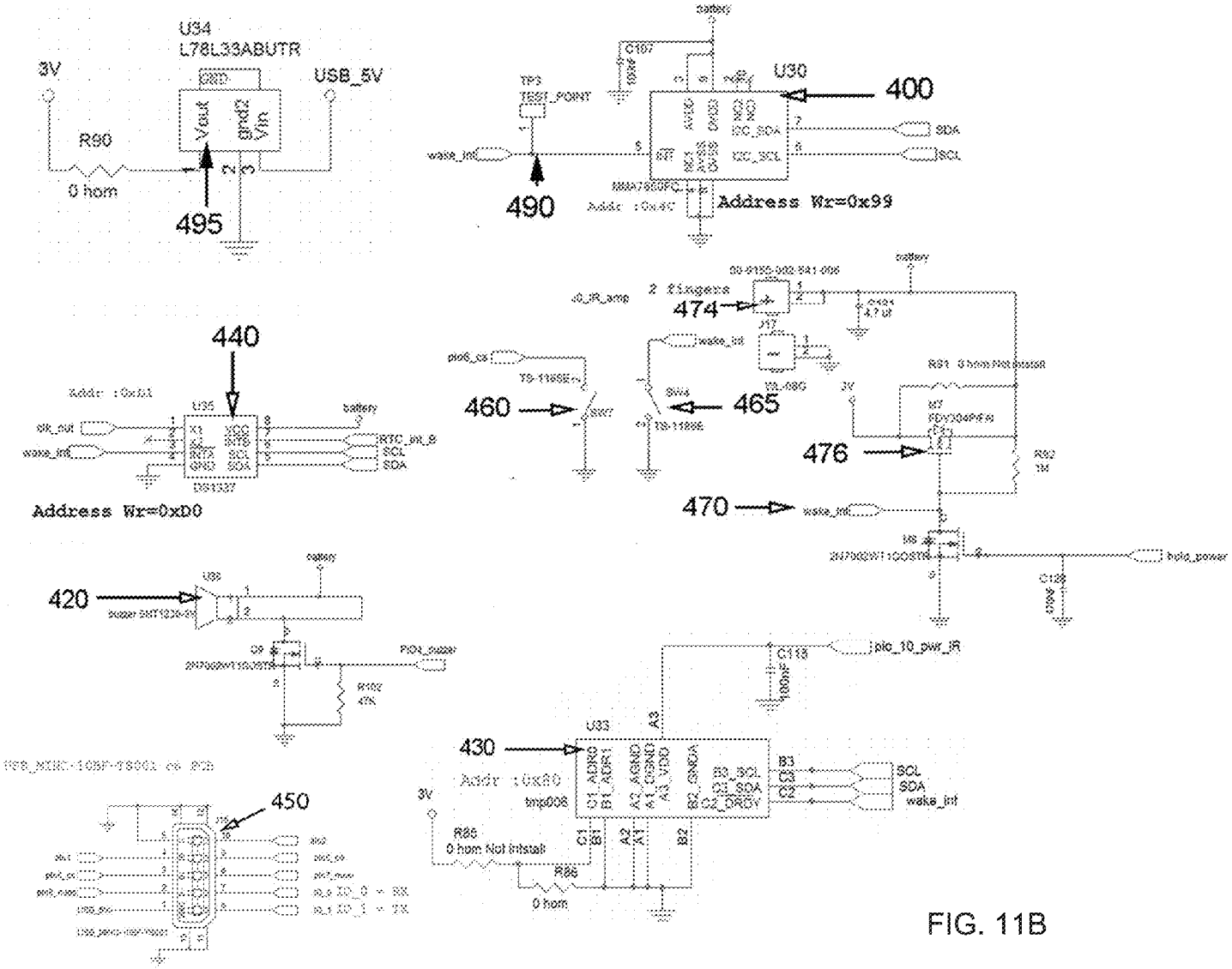

FIG. 11 shows in details the AID device electric schematic diagram. The schematic is self-explanatory for enabled one skilled in the art to make and practice the invention. Several skilled in the different art fields needed to make and practice the invention. A hardware design engineer. An RF design engineer, a firmware software designer, an algorithms designer, a power supply designer for the green technologies compliant, mechanical plastic designer, and a smart phone apps designer. All components data sheet are at the public domain and easy to be retrieved. The present invention does not limit itself to the present selection of the components and any other components with the same functions can easily be use.

The AID device controller 472 manufactured by CSR, with part number CSR1010. It has the processing power and the Artificial Intelligence algorithm to convert the accelerometer 400 Mma7660 with capability to send wake_int 490 signal when the accelerometer 400 is above defined level. The controller 472 communicated with 400 over I2C bus.

Converts from the accelerometer acceleration values to user picked up pills bottle activation values. The controller 472 computes its velocity in 3 axis, its displacement values in 3 axis and time passed from any pick in above 3 axis. The formula to convert measurements of acceleration and converts it to displacement, velocity over time is a common knowledge to one skilled in the art to make and practice the invention. This invention converts these 3 values, displacement—velocity—time with information from Gyro chip as MP-920, a way to get a vector of movement and rotation of the pills bottle cap. The controller 472 Artificial Intelligence algorithms also retrieve information from the IR sensor 430 to detect the user palm opening the pills cap. The auto learning algorithm filters out false triggering, and automatically adjust the detection level to generate the 490 wake_int signal.

The AID device main controller 472 is able to move by itself to low current consumption by change state to sleep mode. That happens automatically when the AID device finishes reporting the smart phone. Only the wake signal input wake it to active mode.

The proximity distance sensor 431 detects when there are pills or liquid in the bottle and sends a wireless signal to any wireless receiver, as Smart phone to order new pills' bottle.

The AID device main controller 472 configures the real time clock 440 DS1337 over I2C to generate an490 wake_int periodically to let The 472AID device main controller 440 test the battery voltage levels and send a keep alive message.

Wake_int 490 signal is generated by Mma7660 400 and by DS1337 440 connected to point 470. Point 470 is transistor gate 476 and it switches on the power from the inner battery 474 to 3V AID device bus line. 3V bus line power all parts in the AID device. wake_int 490 signal connected to the AID device main controller 472 wake 491 pin, which moves the controller from its sleep mode to active mode.

The AID device main controller 472 has the inner capability to RF wirelessly transmits and receives the signal to the smart phone using the antenna 482.

The AID device main controller 472 utilizes the connector 450 to sense external sensor on I2C bus 480 and on UART bus 478.

The AID device connector 450 shows all connection to exterior of the AID device. It also has an option to exposes pin 5V to get external optional power source to power the AID device Voltage regulate chip 495, part number L78L33ABUTR, gets the external 5V power supply and feeds the 3V AID device power bus. This is only an option where no battery is required.

The AID device has a remote infrared temperature sensing chip 430, part number tmp006. This chip can detect any nearby human body temperature. It is located on the PCB rear side of the AID device, facing outside of the attached AID device. The 430 temperature sensing chip is programmed by controllers 472, over I2C, to generate a wake_int 490 signal on user palm hold the AID devices, using its infrared temperature sensing.

The AID device has a button 461 FIG. 151. It is a tact switch. The user can select mode of operation by pressing it. The pattern on long and short time press defines the command to the AID device main controller 472.

The button 465 FIG. 150. It is the AID device on/off switch. Since the controller 472 moves itself to sleep automatically, this button 465 is the button wake-up AID device by sending wake_int 490 signal when pressed.

The AID device buzzer 420, sounds when 472 controller activates it. It sounds an alert sound on trying to select the wrong pills bottle or missed pills consumption time.

The AID device flash memories 410 is the controller 472 memory storage. It stores the controller 472 main application and all data and setting of the AID device. Flash memory 410 powers itself from controller 472 PIO2. When the controller 472 is in a sleep mode, the PIO2 is low, and there is no power wasted on power feed to the flash memory 410.

The terminology used herein is for describing particular embodiments only and is not intended to be limiting of the invention. As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, integers, steps, operations, elements, and/or components, but do not preclude the presence or addition of one or more other features, integers, steps, operations, elements, components, and/or groups thereof.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The disclosed embodiments were chosen to explain the principles of the invention and the practical application, and to enable others of ordinary skill in the art to understand the invention for various embodiments with various modifications as are suited to the particular use contemplated.

We claim:

1. A monitor for monitoring a consumption of pills from a container, the monitor comprises:

an interface;

a controller;

multiple sensors of different types, an alert element; and a transceiver that is configured to exchange information with one or more devices that differ from the monitor;

wherein the interface is configured to interface with the container;

wherein when the monitor interfaces with the container the multiple sensors are configured to (i) detect an attempt to consume a pill of the pills from the container and (ii) evaluate an amount of pills within the container;

wherein the controller is configured to trigger an erroneous consumption alert when the attempt to consume the pill does not correspond to a desired pill consumption schedule; and wherein the transceiver is configured to retrieve from another device information about a physical condition of a person; wherein the controller is configured to determine whether the person should consume a pill from the container based upon the information about a physical condition of a person.

2. The monitor according to claim 1 wherein the container comprises a body and a cover; wherein body has a body interface for connecting the body to the cover; wherein the interface matches the body interface.

3. The monitor according to claim 1 wherein the controller is configured to trigger an missed consumption alert when the monitor did not detect an attempt to consume a pill that was due according to the desired pill consumption schedule.

4. The monitor according to claim 1 wherein the multiple sensors are configured to sense at least one of the followings: (a) a movements of the container, (b) an opening of the container, (c) an amount of pills within the container, (d) a proximity of a human organ to the container.

5. The monitor according to claim 1 wherein the multiple sensors are configured to sense all of the following: (a) movements of the container, (b) an opening of the container, (c) an amount of pills within the container, (d) a proximity of a human organ to the container.

6. A monitor for monitoring a consumption of pills from a container, the monitor comprises: an interface; a controller; multiple sensors of different types, an alert element; and a transceiver that is configured to exchange information with one or more devices that differ from the monitor; wherein the interface is configured to interface with the container; wherein when the monitor interfaces with the container the multiple sensors are configured to (i) detect an attempt to consume a pill of the pills from the container and (ii) evaluate an amount of pills within the container; wherein the controller is configured to trigger an erroneous consumption alert when the attempt to consume the pill does not correspond to a desired pill consumption schedule; and wherein the multiple sensors comprise:

an infrared sensor for sensing a proximity of a human organ to the container, a gyroscope for sensing a rotation of the monitor;

a proximity sensor for evaluating an amount of pills within the container; and an accelerator for sensing a displacement of the container and the cap.

7. The monitor according to claim 1 wherein the alert element comprises a semi-transparent structure and a light emitting element for illuminating the semi-transparent structure.

8. The monitor according to claim 7 wherein the semi-transparent structure comprises a radio frequency antenna.

9. The monitor according to claim 1 wherein the transceiver is configured to retrieve desired pill consumption schedule.

10. The monitor according to claim 1 wherein the controller is configured to trigger a recommended pill consumption alert if it is determined that the person should consume the pill.

11. The monitor according to claim 1 wherein the monitor is positioned within the container when the monitor interfaces with the container.

12. The monitor according to claim 1 wherein the monitor is positioned outside the container when the monitor interfaces with the container.

13. The monitor according to claim 1 wherein the interface comprises an adhesive sheet.

14. The monitor according to claim 1 wherein the multiple sensors comprise an ambient temperature sensor for sensing a storage temperature.

15. The monitor according to claim 1 further comprising at least one button for providing commands to the monitor.

16. The monitor according to claim 1 further comprising at least one button for providing commands to the monitor.

17. The monitor according to claim 1 wherein the controller is configured to detect the attempt to consume the pill by comparing current readings from the multiple sensors to previous readings of the multiple sensors that are associated with one or more previous attempts to consume pills.

* * * * *